US006459870B1

(12) United States Patent
Lee

(10) Patent No.: US 6,459,870 B1
(45) Date of Patent: Oct. 1, 2002

(54) CORONA CARTRIDGE FOR CHARGING PHOTORECEPTORS IN HIGH-SPEED ELECTROPHOTOGRAPHIC APPLICATIONS

(75) Inventor: Michael H. Lee, San Jose, CA (US)

(73) Assignee: Hewlett-Packard Company, Palo Aato, CA (US)

( * ) Notice: Subject to any disclaimer, the term of this patent is extended or adjusted under 35 U.S.C. 154(b) by 0 days.

(21) Appl. No.: 09/839,291

(22) Filed: Apr. 23, 2001

(51) Int. Cl.[7] ..... G03G 15/02

(52) U.S. Cl. ..... 399/115; 250/324; 250/326; 399/170; 399/173

(58) Field of Search ..... 399/24, 31, 100, 399/115, 168, 170–173; 250/324–326

(56) References Cited

U.S. PATENT DOCUMENTS 3,958,162 A * 5/1976 Kuehnle ..... 250/326 X
4,056,723 A * 11/1977 Springett et al. ..... 250/324
5,038,177 A 8/1991 Parker et al.
5,103,260 A 4/1992 Tompkins et al.
5,521,383 A 5/1996 Furukawa et al. ..... 250/324
5,796,103 A 8/1998 Sakai et al. ..... 250/326
6,249,660 B1 * 6/2001 Matsushita et al. ..... 399/115
6,308,032 B1 * 10/2001 Wber et al. ..... 399/168

* cited by examiner

*Primary Examiner*—William J. Royer

(57) ABSTRACT

A corona cartridge for charging a photoreceptor in high-speed electrophotographic applications may include a comb-like corona charging device electronically connected to operate with the photoreceptor, and one or more excess comb-like corona charging devices stored on a shaft or in a dispenser that may be advanced automatically to replace the electronically connected corona charging device when it wears out. The number of excess comb-like corona charging devices (including the electronically connected corona charging device) may be tailored to last as long as the photoreceptor, which may run many months even in high-use operations. Accordingly, the high-speed electrophotographic applications may need to be serviced only when the photoreceptor wears out, thus significantly reducing the maintenance frequency without the side effect of increased ozone production, as in the case of wire-type corona charging devices.

20 Claims, 3 Drawing Sheets

CORONA CARTRIDGE FOR CHARGING PHOTORECEPTORS IN HIGH-SPEED ELECTROPHOTOGRAPHIC APPLICATIONS

TECHNICAL FIELD

The technical field relates to a charging device for electrophotographic applications, and, in particular, to a corona cartridge for high-speed electrophotographic applications.

BACKGROUND

Office or home laser printers have become successful in the marketplace, largely due to the development of print cartridges that house various component parts, such as photoreceptors, charging devices, cleaning receptacles, and other parts, that are likely to fail over a relatively short time. If a print cartridge has enough toner for ten thousand copies, for example, the photoreceptor, charging device, and cleaning receptacle contained in the print cartridge may be designed for that life with some margin for error. After the toner is consumed, the print cartridge may be easily replaced.

However, for high-speed electrophotographic applications, such as high-speed copiers or high-speed laser printers, component parts are considerably heftier and more robust to maintain the necessary tolerances. For example, photoreceptors used in the high-speed electrophotographic applications are much larger, and corona chargers, typically used to charge the photoreceptors in the high-speed electrophotographic applications, are designed for longer life and thus heavier. A print cartridge containing all the usual replacement parts would be too heavy to pick up and maneuver and hence impractical. Accordingly, the component parts are typically replaced separately when necessary, which can be quite frequent during periods of high-volume usage. Such maintenance may need to be performed by an experienced operator.

Because of the cost, size, complexity, and possibly, the need for an experienced operator, the present high-speed electrophotographic applications have been relegated to a central copying or printing operation. If these barriers can be overcome, high-speed copying or printing maybe more successfully marketed and widely distributed. One objective for high-speed electrophotographic applications is to decrease user intervention and prolong the period between major maintenance, so that less-skilled staff can tackle a high-speed, nearly always-on publishing system, so long as the experienced operator does the rare major maintenance.

A typical corona charger consists of one or more wires encased in a shield with one open side facing a photoreceptor. During operation, a high voltage is placed on the wires, while the shield is kept near ground. A metal grid separating the wires and the photoreceptor may be used to set the photoreceptor charge voltage. In high-speed electrophotographic applications, the corona charger can be designed with a spooled wire rather than a single wire, effectively increasing the period between user interventions by approximately a ratio between the spooled wire length and the single wire length, provided that the spooled wire does not break. As the wire wears, the spool is automatically unwound to reveal a new unused section of corona wire.

However, wire coronas in general have a serious drawback. A corona charger produces a considerable amount of ozone, which may damage the photoreceptor and is a health hazard if allowed into an inhabited environment. Ozone emission is particularly acute with negative coronas that are used in nearly all printers, which emit an order of magnitude more ozone than positive coronas. Unfortunately a large majority of printers require negative charging.

Ions that charge the photoreceptor are created by air breakdown near the corona wire. Negative coronas experience breakdown sporadically along the wire length, creating pockets of high charge density interspersed with regions of low or zero charge. In order to produce sufficient charge everywhere, the input current must be increased significantly so that the corona wire will experience breakdown along its entire path. Ozone production increases proportionally with the level of input current. Accordingly, although the spooled-wire charge coronas operate well in high-speed electrophotographic applications, and far extend the life of a single wire, the drawback includes deterioration of images over time and/or increased health and environmental hazard.

Charge rollers have also been used to circumvent the ozone problem while maintaining uniform charging. A charge roller operates by relatively uniform micro breakdowns along its length, reducing the need for excess input current and the accompanying ozone emission. However, because the charge rollers are not sufficiently fast and robust for high-speed electrophotographic applications, charge rollers are limited to low-speed electrophotographic applications.

Some corona chargers do create uniform charging without increased ozone production and can be considered for high-speed electrophotographic applications. These chargers are comb-like devices, such as saw-tooth or pin-electrode charging devices, that place a plurality of uniformly spaced sharp points along the length. Each of these sharp points increases the likelihood of corona breakdown, so that the entire device can experience uniform breakdown at a relatively low current, in contrast to the wire-type negative-charging devices. With reduced input current, the amount of undesirable ozone generated can be significantly reduced to about one-tenth of that generated by wire-type charging devices.

However, unlike wire-type charging devices, comb-like charging devices are bulky and rigid, and cannot easily be wound into a spool or a bobbin to be pulled out whenever they wear out, as is done for the spooled-wired corona charging devices. Accordingly, increased maintenance effort may be required when operating with comb-like charging devices.

SUMMARY

A corona cartridge extends the lives of comb-like charging devices within high-speed electrophotographic applications without active intervention by automatically advancing a new saw-tooth charging device when an old charging device wears out. The corona cartridge may include a comb-like corona charging device, such as a saw-tooth or pin-electrode corona charging device, positioned in a shield case and electronically connected to operate with a photoreceptor for copying or printing, and one or more excess corona charging devices stored in the corona cartridge. The stored excess corona charging devices have the same functionality as the electronically connected corona charging device, and may be advanced automatically to replace the electronically connected corona charging device when the charging device wears out.

In one embodiment, the one or more excess comb-like corona charging devices may be stored on a shaft positioned above the shield case and capable of being lifted an rotated for replacement. In another embodiment, the one or more excess comb-like corona charging devices may be stored in a dispenser that is positioned above the shield case. In yet another embodiment, the number of excess corona charging devices (including the electronically connected corona charging device) may be tailored to last as long as the photoreceptor typically used in the high-speed electrophotographic applications, which may run many months even in high-use operations. Accordingly, by matching total lives of the excess corona charging devices (including the electronically connected corona charging device) to that of the photoreceptor, the high-speed electrophotographic applications may need to be serviced only when the photoreceptor wears out, thus significantly reducing the maintenance frequency without the side effect of increased ozone production, as in the case of wire-type corona charging devices.

DESCRIPTION OF THE DRAWINGS

The preferred embodiments will be described in detail with reference to the following figures, in which like numerals refer to like elements, and wherein.

DETAILED DESCRIPTION

A corona cartridge extends the lives of comb-like charging devices, such as saw-tooth or pin-electrode charging devices, within high-speed electrophotographic applications without active intervention by automatically advancing a new saw-tooth charging device when an old charging device wears out, thus significantly reducing the maintenance frequency without the side effect of increased ozone production, as in the case of wire-type corona charging devices.

Comb-like charging devices are described, for example, in U.S. Pat. No. 5,521,383, to Furukawa et al., entitled "Corona Discharge Device," which is incorporated herein by reference. The comb-like charging devices typically place a plurality of uniformly spaced sharp points along the length where corona breakdown is likely to occur. Each of these sharp points increases the likelihood of corona breakdown, so that corona may break down uniformly to produce uniform charging at a relatively low current, in contrast to the wire-type charging devices. With reduced input current, the amount of undesirable ozone generated can be significantly reduced.

Figure 1A:
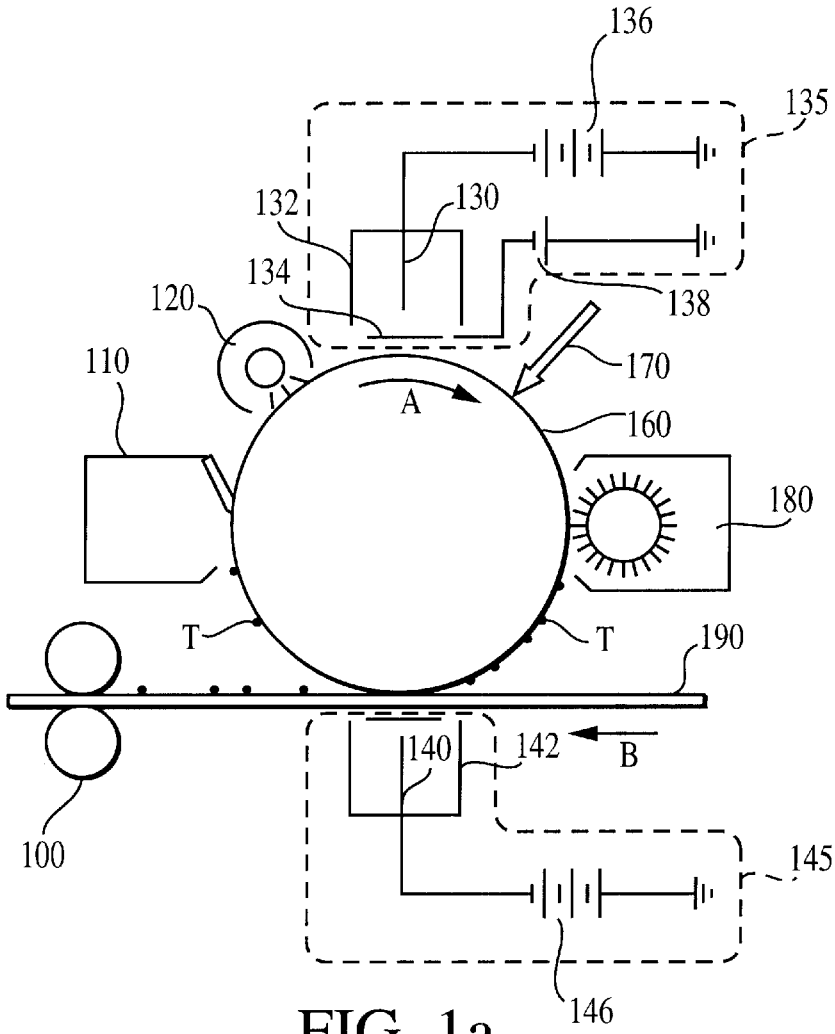
FIG. 1a PRIOR ART
FIG. 1(*a*) and FIG. 1(*b*) illustrate a main portion of an exemplary electrophotographic apparatus with saw-tooth corona charging devices.
Figure 1B:
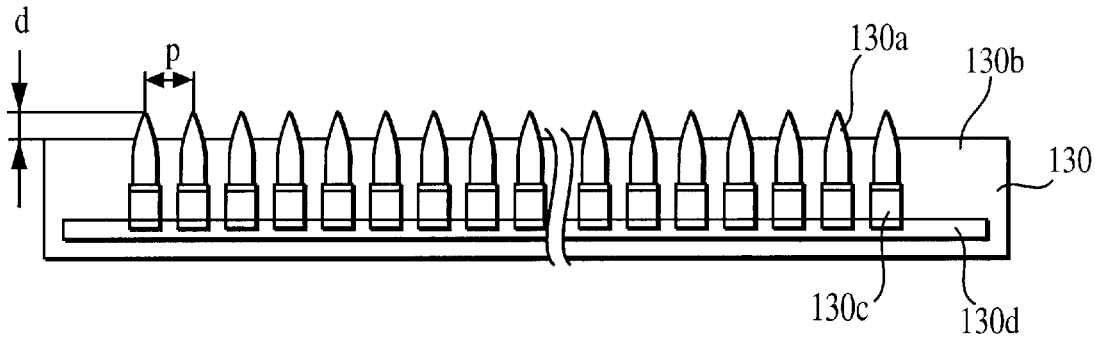
FIG. 1b PRIOR ART

FIG. 1 (a) shows a main portion of a prior art electrophotographic apparatus, such as a copying machine or a laser printer, employing a comb-like corona charging device. The electrophotographic apparatus includes a photoreceptor drum 160 as an image forming body, a developing unit 180, a transfer sheet 190, a fixing unit 100, a cleaner 110, an eraser lamp 120, a corona charging system 135 as a charger, and a corona charging system 145 as a transfer unit.

The corona charging system 135 as the charger includes a corona charging device 130 as a charger, a shield case 132, a grid electrode 134 and high voltage sources 136 and 138. The shield case 132 in the corona charging system 135 as the charger is positioned proximate to the photoreceptor drum 160 and may have a rectangular cross section with one side open.

The corona charging system 145 as the transfer unit includes a corona charging device 140 as a transfer unit, a shield case 142 and a high voltage source 146. The shield case 142 in the corona charging system 145 as the transfer unit also may have a rectangular cross section with one side open.

The photoreceptor drum 160 is formed of a conductive material, such as aluminum, as a base material. A photoconductive layer, for example, of OPC (Organic Photoconductor), may be formed on the peripheral surface of the drum 160. The photoreceptor drum 160 is driven to rotate in a direction denoted by the arrow A about the drum's axis.

FIG. 1(*b*) shows, in enlargement, a main portion of the corona charging device 130 as the charger of FIG. 1(*a*). The corona charging device 130 as the charger includes a plurality of comb-like charge electrodes 130*a*, an insulator substrate 130*b*, a plurality of chip resistors 130*c*, and a common electrode 130*d*. The insulator substrate 130*b* is positioned and supported in the rectangular shield case 132 (see FIG. 1(*a*)). The plurality of comb-like charge electrodes 130*a* are formed, for example, of stainless steel and may be 0.1 mm thick. The comb-like charge electrodes 130*a* are mounted on the insulator substrate 130*b*. The common electrode 130*d* is mounted on the insulator substrate 130*b*, and each of the comb-like charge electrodes 130*a* is connected to the common electrode 130*d* through corresponding chip resistors 130*c*.

The comb-like charge electrodes 130*a* can be formed from a stainless sheet by etching, discharge machining, or by laser processing, for example. As an example, 52 comb-like charge electrodes 130*a* may be arranged at a pitch of 4 mm on the insulator substrate 130*b*. The tip of each comb-like charge electrode 130*a* may protrude from the insulator substrate 130*b* by d=2 mm.

Referring to FIG. 1(*a*), the common electrode 130*d* may be connected to the high voltage source 136. By applying a voltage to the comb-like charge electrodes 130*a* from the high voltage source 136, corona charge may be generated from the tips of the charge electrodes 130*a* and the surface of the photoreceptor drum 160 may be charged. The grid electrode 134 may be placed between the charge electrodes 130*a* and the photoreceptor drum 160, with a voltage of about −900 V, for example, applied from the high voltage source 138. The grid electrode 134 controls electrostatic potential of the photoreceptor drum 160 to be a prescribed potential (for example, about -900 V).

After the surface of the photoreceptor drum 160 is charged to a prescribed potential by the corona charging device 130 as the charger, an electrostatic latent image may be formed on the surface of the photoreceptor drum 160 by exposure light indicated by an arrow 170. The electrostatic latent image may then be developed by the developing unit 180.

When the image formed by a toner T proceeds towards the corona charging device 140 as the transfer unit, the transfer sheet 190 may be fed in the direction of an arrow B toward the corona charging device 140 as the transfer unit, timed with the movement of the photoreceptor drum 160.

The corona charging device 140 as the transfer unit, similar to the corona charging device 130 as the charger, includes a plurality of comb-like charge electrodes (not shown), an insulator substrate (not shown), a plurality of chip resistors (not shown), and a common electrode (not shown). However, the corona charging device 140 as the transfer unit does not include a grid electrode.

The corona charging device 140 as the transfer unit may transfer the toner image on the photoreceptor drum 160 onto the transfer sheet 190, by charging the rear surface of the transfer sheet 190. The transfer sheet 190 on which toner image has been transferred may be fed to the fixing unit 100. Meanwhile, the toner T left on the photoreceptor drum 160 may be taken away by the cleaner 110, and residual charges on the photoreceptor drum 160 may be removed by the eraser lamp 120. Thereafter, the photoreceptor drum 160 may be again charged by the corona charging device 130 as the charger to be ready for the next image forming process.

Accordingly, the comb-like corona charging devices 130 and 140, by placing a plurality of uniformly spaced comb-like charge electrodes 130*a* that increase the likelihood of uniform corona breakdown, produce uniform charging at a relatively low input current, in contrast to the wire-type charging devices. With reduced input current, the amount of undesirable ozone generated can be significantly reduced to about one tenth of that generated by wire-type charging devices.

In an embodiment, a corona cartridge extends the lives of the comb-like charging devices 130 and 140 within the high-speed electrophotographic applications without active intervention, thus prolonging maintenance intervals and decreasing user intervention.

A maintenance interval can only be as long as the shortest-lived component. Aside from toner and paper, the shortest lived components may be the photoreceptor drum 160 and the corona charging device 130 as the charger. A high-speed electrophotographic application can use an a-Si photoreceptor drum 160, which is one type of the photoreceptor drum 160 that lasts for millions of impressions, leaving the corona charging device 130 as the charger being the most frequently replaced component.

Figure 2:
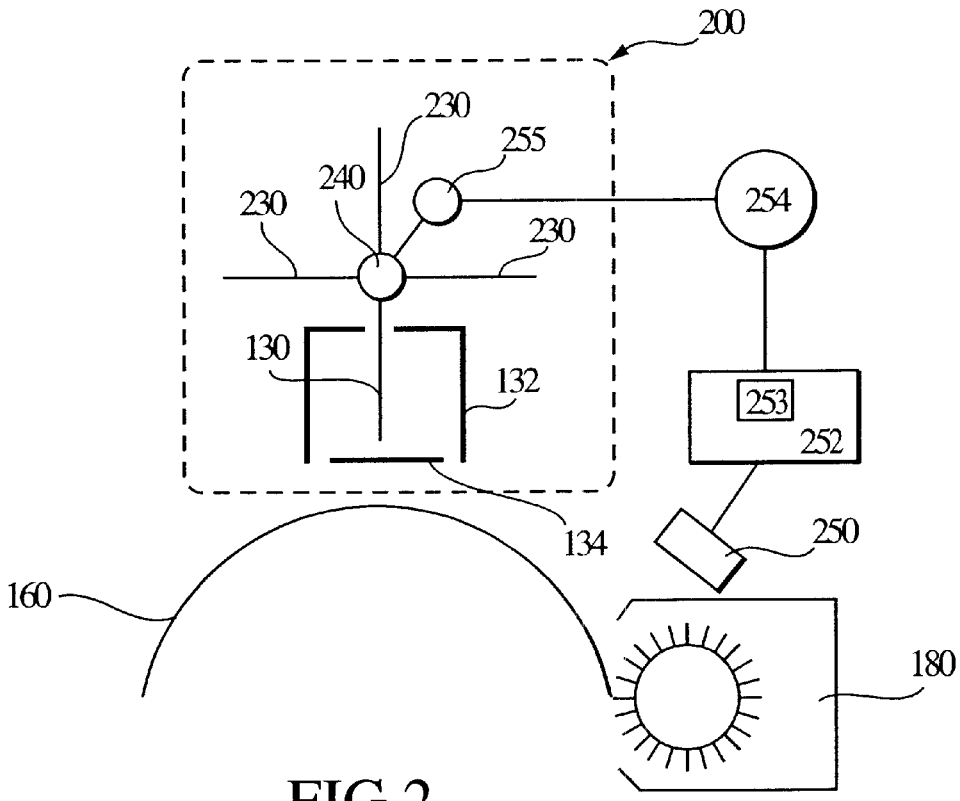
FIG. 2 illustrates an exemplary embodiment of a corona cartridge in accordance with the present invention.

FIG. 2 illustrates an embodiment of an improved corona cartridge 200 for charging the a-Si photoreceptor drum 160 (partially shown in FIG. 2). The corona cartridge 200 may include the comb-like corona charging device 130 as the charger, the shield case 132, the grid electrode 134, the high voltage sources 136 and 138 (shown in FIG. 1(*a*)), a shaft 240, and a plurality of excess comb-like corona charging devices 230.

As described above, the shield case 132 has a rectangular cross section with one side open, and the comb-like corona charging device 130, which is electronically connected to operate with the a-Si photoreceptor drum 160 (partially shown in FIG. 2) for copying or printing, may be positioned and supported in the rectangular shield case 132. The electronically connected corona charging device 130, as well as the excess comb-like corona charging devices 230, may include a plurality of comb-like charge electrodes 130*a*, an insulator substrate 130*b*, a plurality of chip resistors 130*c*, and a common electrode 130*d* (shown in FIG. 1(b)). The insulator substrate 130*b* (shown in FIG. 1(b)) maybe positioned and supported in the rectangular shield case 132, and the grid electrode 134 may be placed between the electronically connected corona charging device 130 and the a-Si photoreceptor drum 160 to control electrostatic potential of the a-Si photoreceptor drum 160 to be a prescribed potential.

The shaft 240 may take the shape of a cross, a star, or any other radially symmetric shape, and may be capable of being lifted and rotated as desired. The excess comb-like corona charging devices 230 may be positioned on and attached to the shaft 240.

A sensor 250, which may be electronically connected to the comb-like corona charging device 130, may detect any degradation in corona function of the electronically connected corona charging device 130. The sensor 250 may be located proximate the a-Si photoreceptor drum 160 and between the electronically connected corona charging device 130 and the developing unit 180. Sensors 250 used to detect degradation in corona function are commonly known in the art. For example, the sensor 250 may be an electrostatic voltmeter (EVM) that continuously monitors the photoreceptor voltage and, together with a processor 252 and software 253, compute when the electronically connected corona charging device 130 needs to be replaced.

After the electronically connected corona charging device 130 is detected to have significantly degraded, i.e., the corona function has dropped below a certain threshold, the processor 252 may cause a motor 254 to prompt appropriate movement in a cam (not shown) and a gear 255, so that the shaft 240 carrying the plurality of excess comb-like corona charging devices 230 may be lifted by the cam and rotated by the gear 255 to insert one of the excess comb-like corona charging devices 230 in the shield case 132 to continue the copying or printing job.

The number of excess comb-like corona charging devices 230 located on the shaft 240 (including the electronically connected corona charging device 130 in use) may be tailored to last approximately as long as the a-Si photoreceptor drum 160, so that the high-speed electrophotographic applications may need to be serviced only when the a-Si photoreceptor drum 160 wears out, thus significantly reducing the maintenance frequency without the side effect of increased ozone production, as in the case of wire-type corona charging devices.

Alternatively, the lives of the total corona charging devices 130 and 230 may not match the life of the a-Si photoreceptor drum 160, and only a portion of the corona charging devices 230 may be replaced during maintenance when the a-Si photoreceptor drum 160 wears out.

Figure 3:
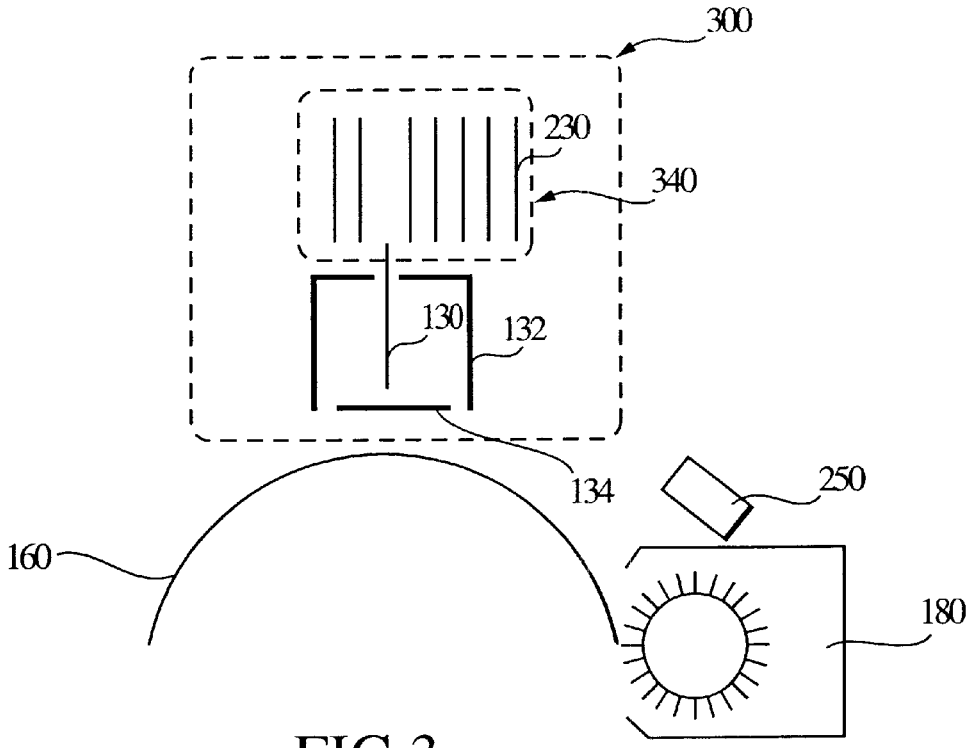
FIG. 3 illustrates another exemplary embodiment of a corona cartridge in accordance with the present invention.

FIG. 3 illustrates another embodiment of a corona cartridge 300 for charging the a-Si photoreceptor drum 160. The corona cartridge 300 may include the comb-like corona charging device 130 as the charger, the shield case 132, the grid electrode 134, the high voltage sources 136 and 138 (not shown in FIG. 3), a dispenser 340, and a plurality of excess comb-like corona charging devices 230.

As described above, the shield case 132 may have a rectangular cross section with one side open, and the comb-like corona charging device 130, which is electronically connected to operate with the a-Si photoreceptor drum 160 (partially shown in FIG. 3) for copying or printing, may be positioned and supported in the rectangular shield case 132. The electronically connected corona charging device 130, as well as the excess comb-like corona charging devices 230, may include a plurality of comb-like charge electrodes 130*a*, an insulator substrate 130*b*, a plurality of chip resistors 130*c*, and a common electrode 130*d* (shown in FIG. 1(*b*)). The insulator substrate 130*b* (shown in FIG. 1((*b*)) may be positioned and supported in the rectangular shield case 132, and the grid electrode 134 may be placed between the electronically connected corona charging device 130 and the a-Si photoreceptor drum 160 to control electrostatic potential of the a-Si photoreceptor drum 160 to be a prescribed potential.

A dispenser 340, which may be positioned above the shield case 132, may store the excess comb-like corona charging devices 230. A sensor 250, which may be electronically connected to the comb-like corona charging device 130, may detect any degradation in corona function of the electronically connected corona charging device 130. The sensor 250 may be located proximate the a-Si photoreceptor drum 160 and between the electronically connected corona charging device 130 and the developing unit 180.

Similar to the embodiment illustrated in FIG. 2, after the electronically connected corona charging device 130 is detected to have significantly degraded, the corona charging device 130 may be automatically lifted from the shield case 132 and moved into, for example, the left end of the dispenser 340. The dispenser 340 may shift, for example, to the left, and insert one of the unused excess comb-like corona charging devices 230 located, for example, at the right end of the dispenser 340, into the shield case 132 to be electronically connected for operation.

Since the number of excess comb-like corona charging devices 230 located in the dispenser 340 (including the electronically connected corona charging device 130 in use) maybe tailored to last approximately as long as the a-Si photoreceptor drum 160, the corona cartridge 300 may need to be replaced only when the a-Si photoreceptor drum 160 wears out, thus significantly reducing the maintenance frequency.

Alternatively, if the total lives of the corona charging devices 130 and 230 do not match the life of the a-Si photoreceptor drum 160, only a portion of the corona charging devices 230 may be replaced during maintenance when the a-Si photoreceptor drum 160 wears out. In this embodiment, only the used excess comb-like corona charging devices 230, i.e., the excess corona charging devices 230 stored at the left end of the dispenser 340 in this example, may be replaced during maintenance. Accordingly, the corona cartridge 300 may include more than the bare minimum of the excess comb-like corona charging devices 230 without the concern that some of the excess corona charging devices 230 may be wasted.

Figure 4:
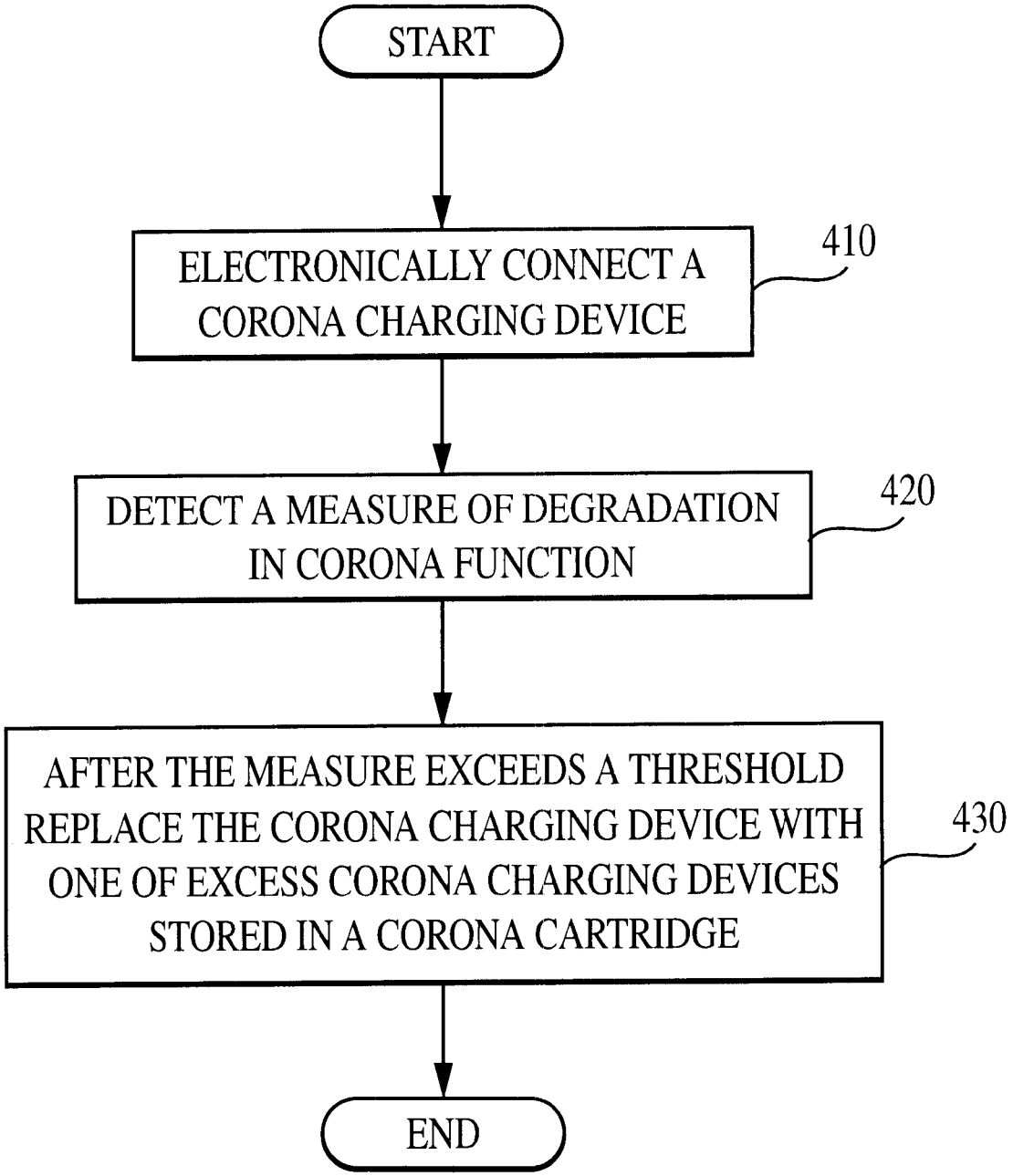
FIG. 4 is a flow chart of a method for replacing corona charging devices in high-speed electrophotographic applications.

FIG. 4 illustrates a method for replacing corona charging devices in high-speed electrophotographic applications. A comb-like corona charging device 130, typically positioned in a shield case 132, may be electronically connected to charge an a-Si photoreceptor drum 160 in the high-speed electrophotographic applications, step 410. A plurality of excess comb-like charging devices 230 may be stored in a corona cartridge 200 or 300. The excess comb-like charging devices 230 may be stored on a radially symmetrically shaped shaft 240 or in a dispenser 340, both may be positioned above the shield case 132. A sensor 250, electronically connected to a processor 252, may be placed between the electronically connected corona charging device 130 and the developing unit 180 in order to detect a degradation in corona function of the electronically connected comb-like corona charging device 130, step 420. After the electronically connected corona charging device 130 is detected to have significantly degraded, i.e., the corona function has dropped below a certain threshold, the processor 252 may cause a motor 254 to prompt appropriate movement in a cam and a gear 255 to replace the electronically connected corona charging device 130 with one of the excess comb-like corona charging devices 230 to continue the copying or printing job, step 430.

While the corona cartridge has been described in connection with an exemplary embodiment, it will be understood that many modifications in light of these teachings will be readily apparent to those skilled in the art, and this application is intended to cover any variations thereof.

What is claimed is:

1. A corona cartridge for charging a photoreceptor in a high-speed electrophotographic application, comprising:

a shield case positioned proximate the photoreceptor;

a comb-like corona charging device positioned in the shield case and electronically connected to operate with the photoreceptor; and one or more excess comb-like corona charging devices stored in the corona cartridge, wherein the one or more excess comb-like corona charging devices can function as the electronically connected comb-like corona charging device, and wherein the electronically connected comb-like corona charging device can be replaced by one of the one or more excess comb-like corona charging devices.

2. The corona cartridge of claim 1, wherein the one or more excess comb-like corona charging devices are stored on a shaft positioned above the shield case and capable of being lifted and rotated for replacement.

3. The corona cartridge of claim 2, wherein the one or more excess comb-like corona charging devices are placed radially symmetrically on the shaft.

4. The corona cartridge of claim 1, further comprising a sensor, operably connected to the electronically connected comb-like corona charging device, that is capable of detecting a degradation in corona function of the electronically connected comb-like corona charging device.

5. The corona cartridge of claim 4, wherein the sensor is located proximate the photoreceptor and between the electronically connected comb-like corona charging device and a developing unit.

6. The corona cartridge of claim 1, wherein total lives of the one or more excess comb-like corona charging devices and the electronically connected comb-like corona charging device substantially match the life of the photoreceptor.

7. The corona cartridge of claim 1, wherein the one or more excess comb-like corona charging devices are stored in a dispenser that is positioned above the shield case.

8. The corona cartridge of claim 7, wherein the dispenser is configured to store unused one or more excess comb-like corona charging devices at one end of the dispenser and used one or more excess comb-like corona charging devices at an opposite end of the dispenser.

9. The corona cartridge of claim 8, wherein only the used one or more excess comb-like corona charging devices can be replaced during maintenance.

10. A method for replacing corona charging devices in high-speed electrophotographic applications, comprising:

electronically connecting a comb-like corona charging device for charging a photoreceptor in the high-speed electrophotographic applications, wherein the comb-like corona charging device is positioned in a shield case;

detecting a measure of a degradation in corona function of the comb-like corona charging device; and when the measure exceeds a threshold, replacing the electronically connected comb-like corona charging device with one of one or more excess comb-like corona charging devices stored in a corona cartridge.

11. The method of claim 10, wherein the detecting step includes using a sensor operably connected to the electronically connected comb-like corona charging device.

12. The method of claim 11, wherein the detecting step includes using a processor operably connected to the sensor, wherein the processor detects when the measure exceeds the threshold.

13. The method of claim 12, wherein the replacing step includes using a motor and a gear that are operably connected to the processor to replace the electronically connected comb-like corona charging device with one of the one or more excess comb-like corona charging devices stored in the corona cartridge.

14. An apparatus for charging photoreceptors in high-speed electrophotographic applications, comprising:

a photoreceptor for a high-speed electrophotographic application; and a corona cartridge capable of charging the photoreceptor, wherein the corona cartridge comprises:

a shield case positioned proximate the photoreceptor;

a comb-like corona charging device positioned in the shield case and electronically connected to operate with the photoreceptor; and one or more excess comb-like corona charging devices stored in the corona cartridge, wherein the one or more excess comb-like corona charging devices can function as the electronically connected comb-like corona charging device, and wherein the electronically connected comb-like corona charging device can be replaced by one of the one or more excess comb-like corona charging devices.

15. The apparatus of claim 14, wherein the one or more excess comb-like corona charging devices are stored on a shaft that is positioned above the shield case and capable of being lifted and rotated for replacement.

16. The apparatus of claim 14, further comprising a sensor, operably connected to the electronically connected comb-like corona charging device, that is capable of detecting a degradation in corona function of the electronically connected comb-like corona charging device.

17. The apparatus of claim 14, wherein total lives of the one or more excess comb-like corona charging devices and the electronically connected comb-like corona charging device substantially match the life of the photoreceptor.

18. The apparatus of claim 14, wherein the one or more excess comb-like corona charging devices are stored in a dispenser that is positioned above the shield case.

19. The apparatus of claim 18, wherein the dispenser is configured to store unused one or more excess comb-like corona charging devices at one end of the dispenser and used one or more excess comb-like corona charging devices at an opposite end of the dispenser.

20. The apparatus of claim 19, wherein only the used one or more excess comb-like corona charging devices can be replaced during maintenance.

* * * * *